US006104014A

United States Patent [19]

Chung

[11] Patent Number: 6,104,014

[45] Date of Patent: Aug. 15, 2000

[54] MICROWAVE AND STEAM COOKING SYSTEM

[76] Inventor: Jing-Yau Chung, 3907 Dennis St., Houston, Tex. 77004

[21] Appl. No.: 09/391,801

[22] Filed: Sep. 9, 1999

Related U.S. Application Data

[62] Division of application No. 08/946,022, Oct. 7, 1997, Pat. No. 5,945,021

[60] Provisional application No. 60/027,888, Oct. 7, 1996.

[51] Int. Cl.[7] ..... H05B 6/78

[52] U.S. Cl. ..... 219/682; 219/731; 219/401; 219/762; 99/451; 99/467

[58] Field of Search ..... 219/682, 684, 219/698, 699, 700, 731, 732, 738, 762, 401; 99/DIG. 14, 451, 467, 477, 410; 426/241, 243

[56] References Cited

U.S. PATENT DOCUMENTS

| | | | |
|---|---|---|---|
| 3,495,071 | 2/1970 | Niles | 219/401 |
| 3,889,009 | 6/1975 | Lipoma | 219/682 |
| 5,545,874 | 8/1996 | Hansson | 219/401 |
| 5,556,566 | 9/1996 | Cappello et al. | 219/682 |
| 5,767,492 | 6/1998 | Pinceloup | 219/699 |

*Primary Examiner*—Philip H. Leung
*Attorney, Agent, or Firm*—Mark A. Oathout

[57] ABSTRACT

The invention relates to a system for cooking or heating a food product with combined steam and microwave energy having a microwave oven with a carrousel for moving the food product into and out of the oven. The food product is placed in a steaming compartment with a volume of water. As the compartment moves through the oven, the microwave cooks or heats the food product and converts the water to steam for steam cooking or steam heating the same food product.

3 Claims, 7 Drawing Sheets

MICROWAVE AND STEAM COOKING SYSTEM

This application is a Divisional Application based on prior U.S. patent application Ser. No. 08/946,022 filed Oct. 7, 1997 U.S. Pat No. 5,945,021 which is based on Provisional application Ser. No. 60/027,888 filed Oct. 7, 1996.

BACKGROUND OF THE INVENTION

Food manufacturers are constantly looking for a new improved method for preparing foods. In particular, a rapid and efficient method which also produces high quality foods is always desirable. The invention of a viable food processing equipment related to implementing the above mentioned new method is also an important subject matter for a food and an equipment manufacturer.

When steam cooking or heating is involved in preparing food products such as oriental dumplings and other oriental "Diam-sims", it is highly desirable to find a new rapid method of accomplishing the process due to the time consuming nature of the conventional steaming process. For example, the conventional steam cooking of dumplings requires steaming time of 20 to 40 minutes at 210 degrees Fahrenheit depending on the size and the initial temperature of the dumplings. Using a pressure cooker, one can speed up the process by raising the steam temperature. But the process requires the use of cumbersome equipment.

A dumpling or an oriental "Diam-sim" generally consists of a skin made from a dough and an inner filling made of vegetables and meats. A conventional steaming process provides heating at the outer skin. The inner filling receives heat after it is conducted through the cross section of the dumpling. By the time the core of the inner filling is fully cooked at above 165 degrees Fahrenheit, the outer skin is generally well cooked for an extra length of time. This is particularly true when the dumpling is frozen prior to the cooking. For example, the outer layer of the meat and/or vegetables may be overcooked in the time it takes to thaw and cook the core of the meat and/or vegetables. In addition, the juice of the meat may be absorbed by or even penetrate the outer skin of the dumpling making the outer skin less than desirable.

BRIEF SUMMARY OF THE INVENTION

A solution for a rapid steam cooking or steam heating a dumpling or any other similar food is to heat the outer skin and the inner filling simultaneously by means of combined steam and microwave heating. Using this method, the outer skin is heated by high temperature steam as well as the microwave energy, while the inner filling is heated by mainly the microwave energy and some steam energy transferred from the outer skin.

Experiments at the applicant's oriental food manufacturing plant revealed that such simultaneous microwave and high temperature steam heating reduced the heating time as much as 20 times. A further reduction in heating time can be achieved by applying higher power microwave energy to the process.

The present invention is related to a new system which provides not only the combined heating mentioned above, but also an efficient and safe way of transporting a food object into and out of the microwave field. The system consists of a microwave oven with a carrousel for moving the food products into and out of the oven. The food products are placed in a number of air tight steaming compartments with a volume of water in each compartment.

As the compartments move thorough the oven, the microwave energy cooks the food products directly, and in the mean time, it converts the water to steam which cooks the same food product simultaneously. The steam so generated by the microwave energy can reach a temperature higher than that under atmospheric pressure since the compartment is air tight thus creating high pressure steam cooking similar to that created by a conventional pressure steam cooker.

DETAILED DESCRIPTION

Figure 1:
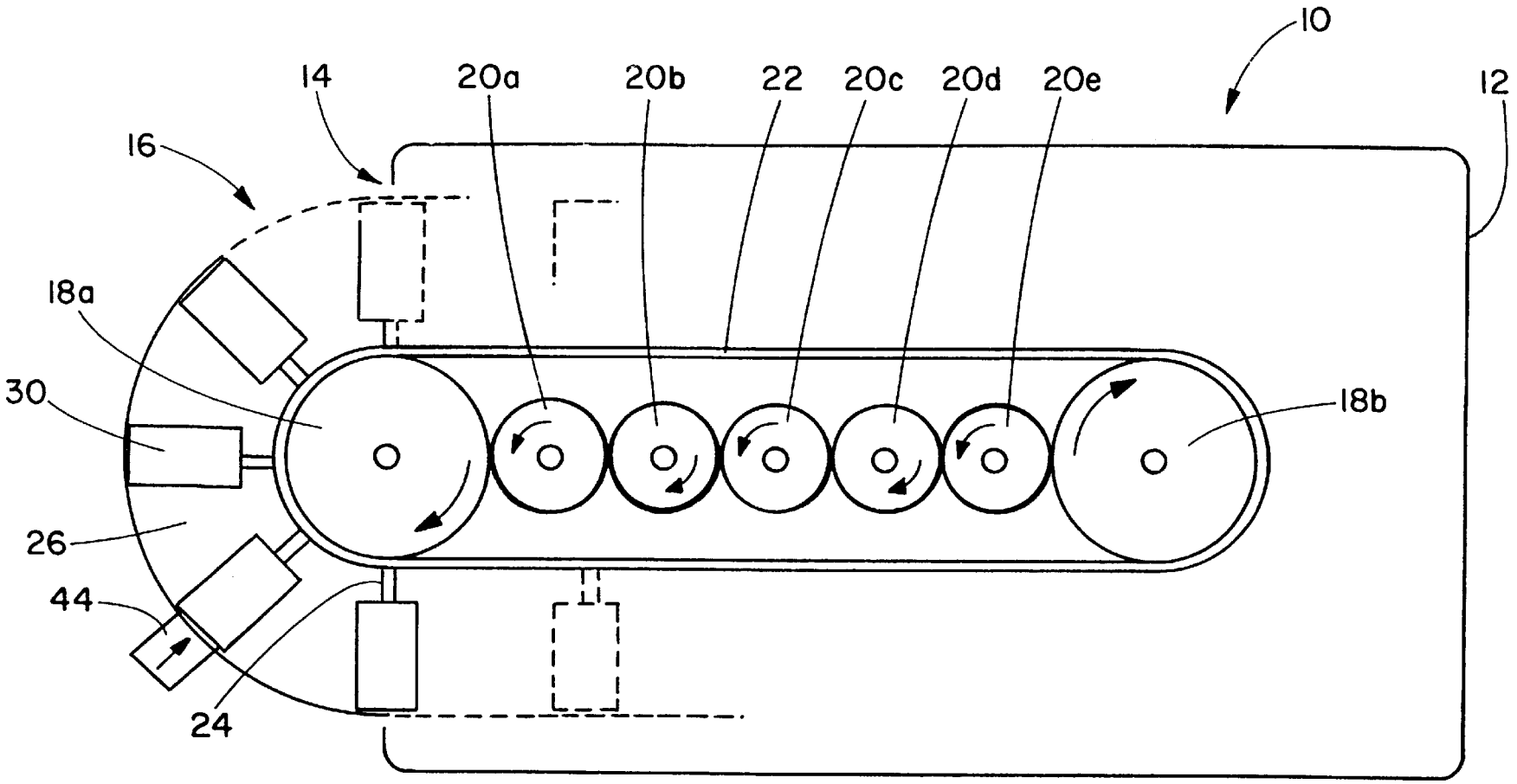
FIG. 1 is a top schematic view of the invention.
Figure 2:
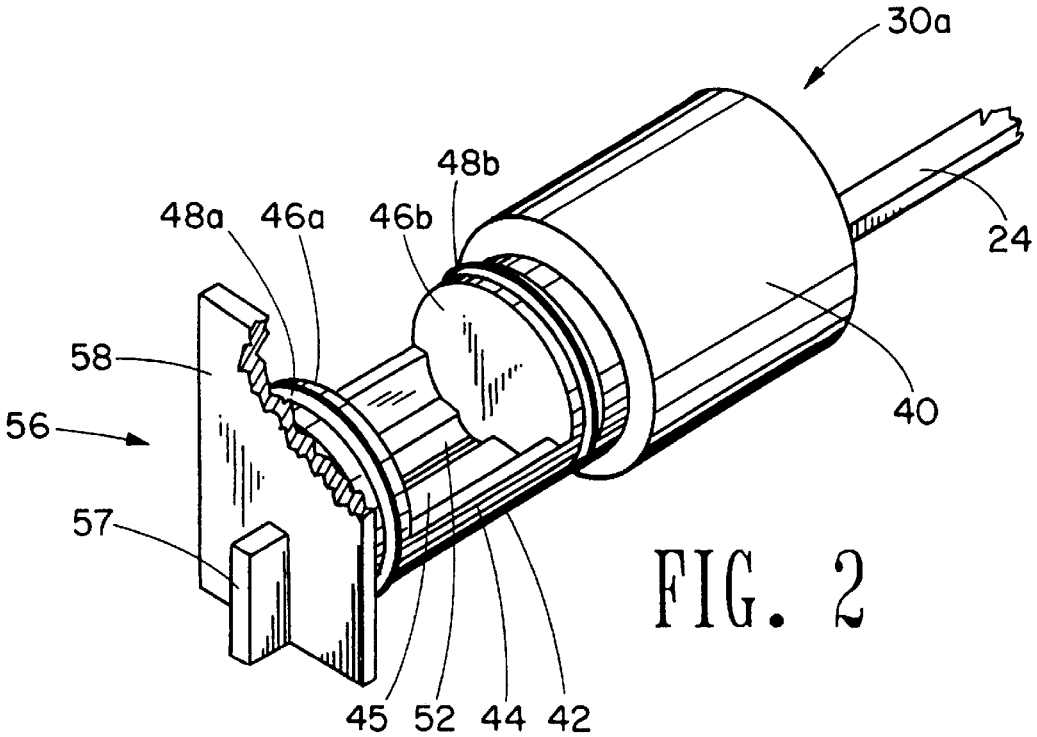
FIG. 2 is a perspective view of one type of compartment of the invention.
Figure 3:
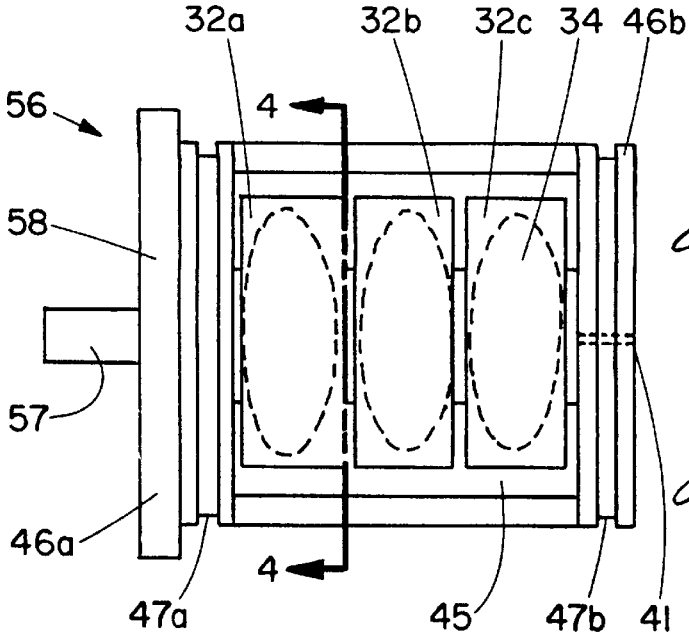
FIG. 3 is a top view of the receptacle shown in FIG. 2 but containing three dumpling trays.
Figure 4:
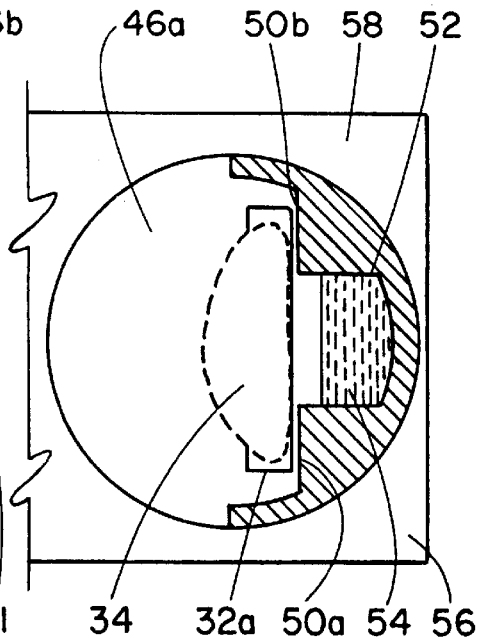
FIG. 4 is a sectional view taken along line 4—4 of FIG. 3.
Figure 5:
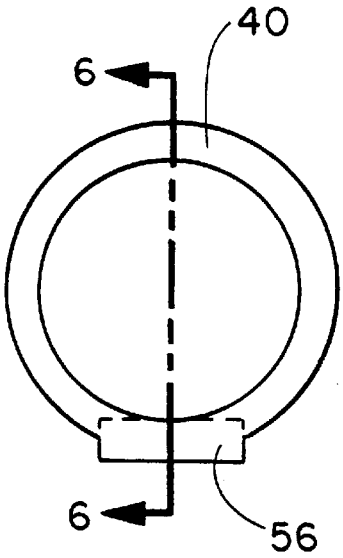
FIG. 5 is an elevational view of the sleeve shown in FIG. 2.
Figure 6:
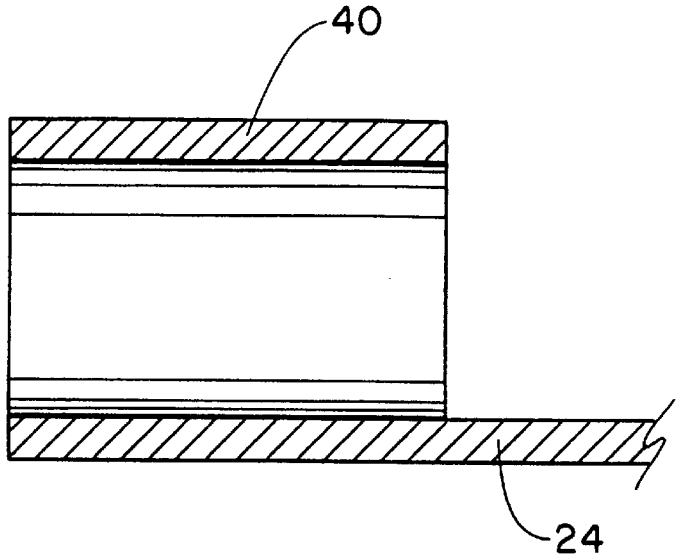
FIG. 6 is a sectional view taken along line 6—6 of FIG. 5.

Referring to FIG. 1, the microwave and steam heating system 10 is shown. The microwave steam heating system 10 generally includes an oven 12 having a microwave source/receiver (not shown), a carrousel 16 and a plurality of compartments 30 which travel around the carrousel 16 with foods contained in each individual compartment.

Some examples of food products which may be cooked or heated in the system 10 are Oriental dumplings, Oriental "Diam-sims", vegetables, rice, etc. For the purpose of discussion below, "dumpling" will be used to represent the general food items mentioned above. Initially the dumpling is raw or pre-cooked. In either case, it is then frozen, refrigerated or at room temperature. Then, if the dumpling is raw it must be cooked, or if it is pre-cooked it must be heated (for the purpose of discussion below, cooking or heating, will be referred to as "cooking", "cooked", etc.). The cooking takes place in oven 12.

A control system (not shown) and a microwave source (magnetron) (not shown) are connected to oven 12. Oven 12 defines a cavity to provide a microwave chamber for heating the dumpling. Oven 12 also defines an opening 14 which allows the passage of the foods into and out of the oven 12.

A carrousel 16 is used to move, transport or revolve the dumpling into and out of oven 12. The carrousel 16 may be driven by a motor (not shown) primarily through a pulley

18*a* or 18*b*, or one of the gears 20*a*, 20*b*, 20*c*, 20*d* or 20*e*. The pulleys 18*a* and 18*b* drive a belt 22. Connector rod 24 is connected at one end to belt 22 and is connected at the other end to a compartment 30 for transmitting movement from the belt 22 to the compartments 30. The carrousel 16 has a base 26 which may be coated with a material such as Teflon to reduce the friction between compartments 30 and carrousel 16. The underside (not shown) of the compartments 30 may also include some structure (such as a roller) to assist the compartment 30 in moving around carrousel 16.

The clearance between carrousel 16 and the opening 14 in oven 12 is structured in such a way that the gap is too small for the microwave energy to escape from oven 12 while allowing the compartments 30 to travel freely in and out of oven 12. Oven 12 may also include an on-off microwave switch feature to limit the "on" time to when oven 12 is in use for cooking.

The compartment 30 generally is a self-containing structure which holds the dumpling and a volume of water. When the compartment 30 is closed, the dumpling will be totally enclosed or be circumjacent to the interior structure of the compartment 30. The compartment 30 may be made of plastic or any other suitable microwavable material.

When the compartment 30 passes into oven 12, the dumpling and the volume of water will be exposed to the microwave field which excites the water molecules both in the volume of water and in the food. This will initiate heating of the dumpling outer skin, inner filling and of the volume of water. The water converts to steam regardless of whether the volume of water begins as ice or in the liquid state. Since the compartment 30 is self containing, the steam is retained within the compartment causing the food to be steam heated under a pressure greater than the atmospheric pressure. The compartment 30 must also include a structure allowing steam to be released from the compartment at a certain pressure as will be discussed further below. Several different embodiments of compartment 30 will be described in greater detail below.

Referring to FIGS. 2–6 one embodiment of a compartment 30*a* is shown. The dumplings 34 are preferably placed in trays 32*a–c* and the trays 32*a–c* are placed within the compartment 30*a*. The trays 32*a–c* should be water proof or water resistant to enable the trays to retain water. By way of example the tray may be coated with polyester or some other microwavable polymer. As shown, one dumpling 34 may be placed in each tray 32*a–c*. Any meat juice released during heating of the dumpling 34 is captured in the tray thereby keeping the juice from flowing on compartment 30. The tray may also be used for serving the dumpling. A small quantity of ice may be pre-packaged or placed in each tray 32*a–c* along with the frozen dumpling. The trays may include a volume of water in the liquid state as opposed to the frozen state. The amount of water to be added to the compartments 30 is somewhat dependant upon the size of the compartments 30 and, the size and the initial temperature of the food to be cooked. It should be noted that a volume of water may be added either in the tray or in the compartment or in both.

The compartment 30*a* includes a sleeve 40 and a receptacle 42. The sleeve 40 has two open ends. The arm 24 may be attached to one end of the sleeve 40. The receptacle 42 includes a platter portion 44 and two diametrical endwalls 46*a, b*. The diametrical endwalls 46*a, b* adjoin both ends of the platter portion 44 and have an outer diameter less than the inner diameter of the open ends of the sleeve 40. The endwalls 46*a, b* each have an o-ring groove 47*a,b*, respectively, running around the circumference of the endwalls 46*a, b*. O-rings 48*a, b* are placed in the respective o-ring grooves 47*a*, 47*b* for affecting a seal between the endwalls 46*a, b* and the sleeve 40 when the receptacle 42 is inserted into the sleeve 40. The top face 45 of the platter portion 44 includes ridges 50*a, b* (two shown) which border a trough 52. A small volume of water 54 may be placed in the trough 52. The water 54 is to be converted to steam during the heating process described in this application. The apex of trough 52*a* and the apex of trough 52*b* are of equal height so that the trays 32*a, b* and *c* will be leveled when placed on the top face 45 of platter portion 44. An endpiece 56 abuts the endwall 46*a*. The endpiece 56 includes a handle 57 and a handguard 58. The handle 57 is used by the food operator to insert the receptacle into the sleeve 40 and for removing the receptacle 42 from the sleeve 40. The handguard 58 is for shielding the hand of the food operator from hot steam which will rise out of the receptacle 42 when the receptacle 42 is removed from the sleeve 40. Preferably the handguard 58 will extend beyond the diameter of endwall 46*a* on the top and sides approximately one inch. The compartment 30*a* may include a pressure release mechanism such as a small diameter vent line 41 through the endwall 46*a* which may release at thirty PSI for example.

Figure 7:
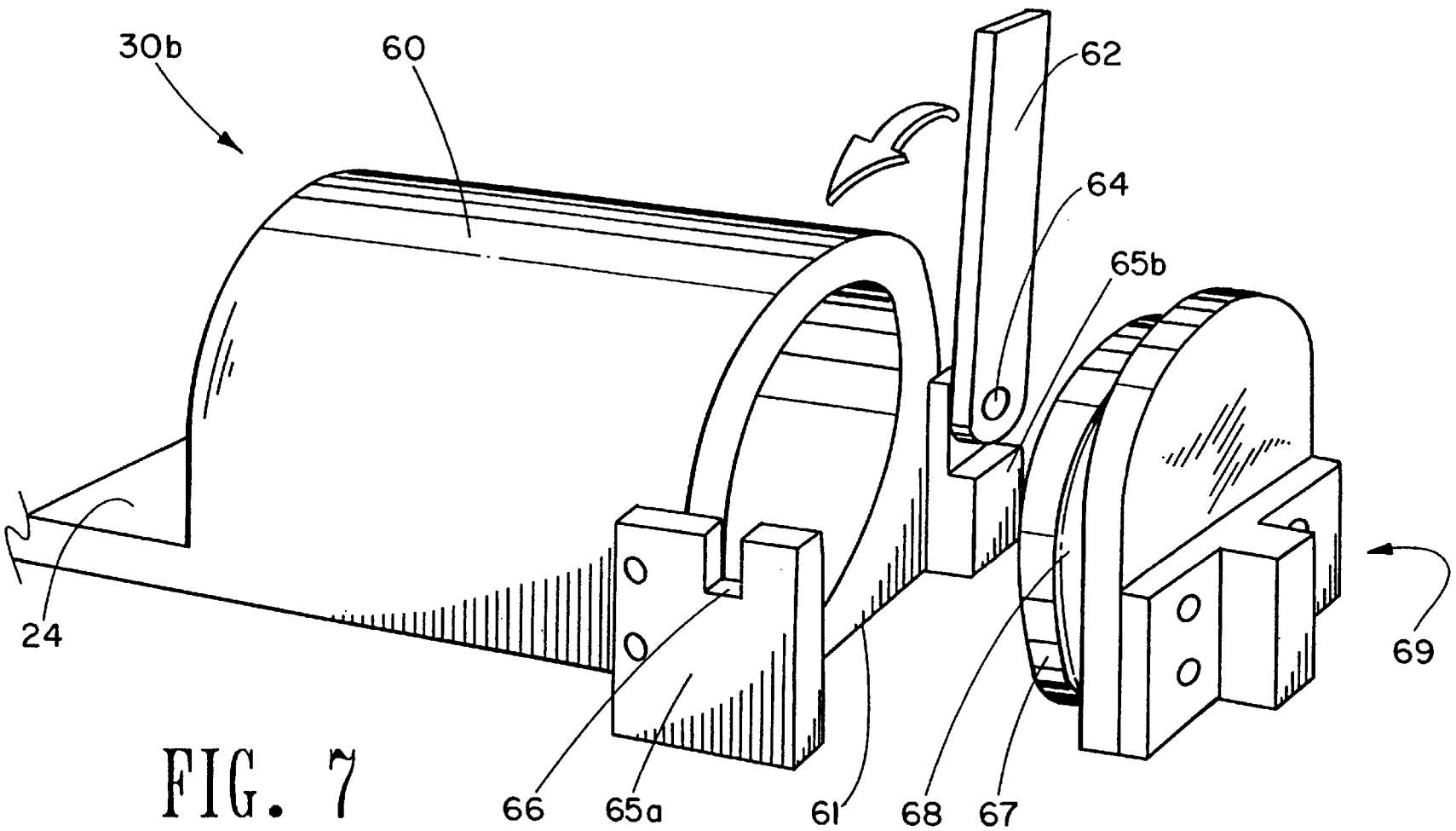
FIG. 7 is a perspective view of a second type of compartment.

Referring to FIG. 7, another embodiment 30*b* of a compartment 30 is shown. The compartment 30*b* is similar to compartment 30*a* in that it has a sleeve 60, a diametrical endwall 67 to be inserted into the sleeve 60 and an O-ring 68 for affecting a seal between the diametrial endwall 67 and the sleeve 60. The diametrical endwall 67 also includes an endpiece 69 similar to the endpiece 56 described in FIGS. 2–6. The sleeve 60 has one end which is open and another end which is closed. The bottom 61 of the sleeve 60 is planar for stability. Mounting blocks 65*a,b* are attached to the sleeve 60. A stop bar 62 is attached to and rotates around a pin 64 which connects the stop bar 62 to the mounting block 65*b*. Mounting block 65*a* includes a notch 66 which accepts stop bar 62. When the diametrical endwall 67 is fully inserted into the sleeve 60, the stop bar 62 may be rotated over endpiece 69 into notch 66 to lock the diametrical endwall 67 within the sleeve 60.

Figure 8:
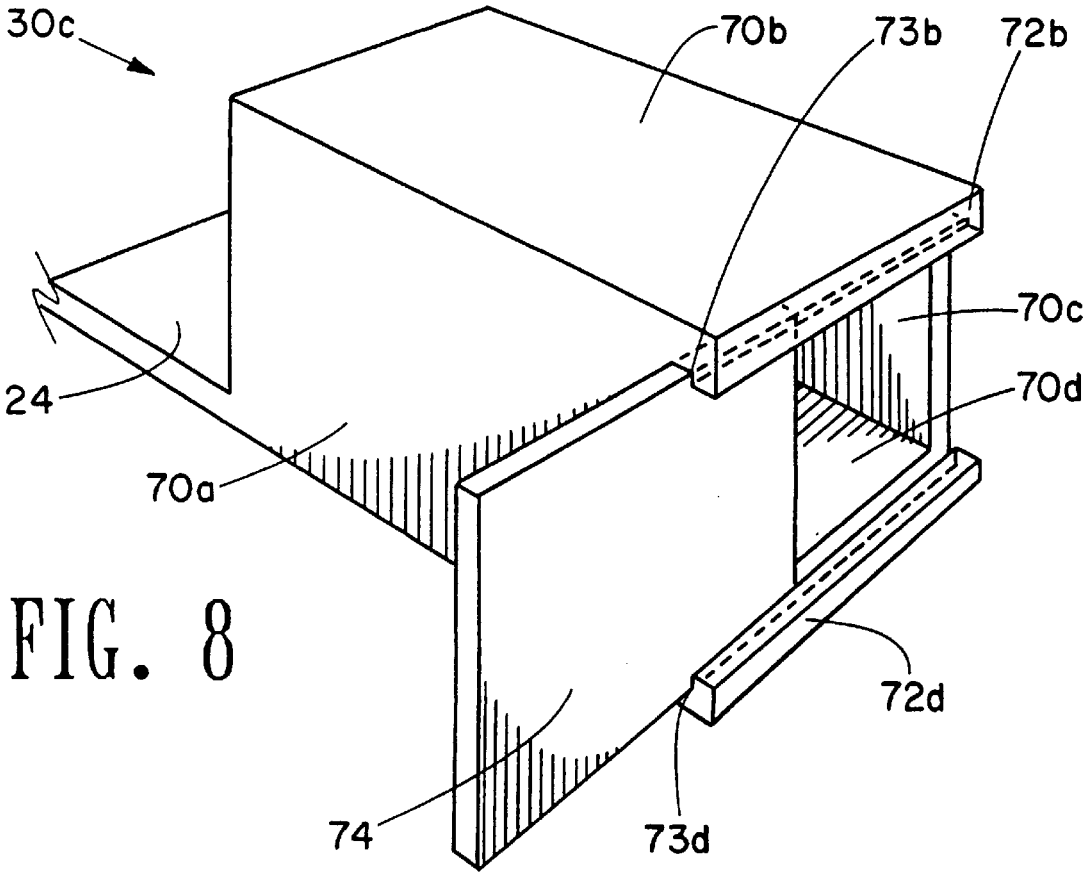
FIG. 8 is a perspective view of a third type of compartment.

Referring to FIG. 8, another embodiment 30*c* of a compartment 30 is shown. The compartment 30*c* includes sidewalls 70*a,b,c,d* and an endwall (not shown) on one end. The other end of the compartment 30*c* includes a lip 72*b* which extends from sidewall 70*b* and a lip 72*d* which extends from sidewall 70*d*. Lip 72*b* defines a guide groove 73*b*, and lip 72*d* defines a guide groove 73*d*. A door 74 may be slid into the guide grooves 73*b*, d for closing the compartment 30*c*.

Figure 9:
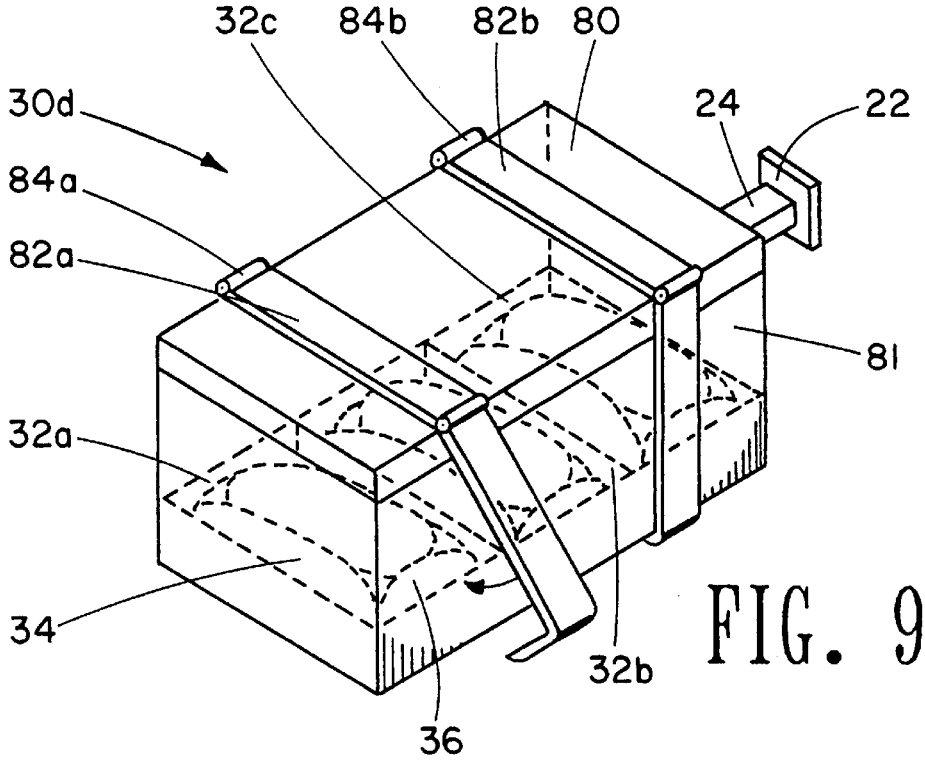
FIG. 9 is a perspective view of a fourth type of compartment.

Referring to FIG. 9, the compartment 30*d* includes a bottom wall (not shown), four sidewalls 81 (two shown) and an overlapping lid 80. A pair of latch mechanisms 82*a*, 82*b* which are connected to the overlapping lid 80 by hinges 84*a,b* which abut the lid 80 and will abut the sidewall 81 when the latch mechanisms 82*a*, 82*b* are in the latched position (engaging the bottom of the compartment 30*d*). When the compartment 30*d* is latched, it will retain steam to enhance the steaming of the dumplings 34. However, to prevent the steam pressures from reaching a critical pressure at which the compartment 30*d* may fail, the latch mechanism 82*a*, 82*b* in conjunction with the compartment 30*d* should be designed so that the latches will release prior to reaching the critical pressure. The overlapping lid 80 and/or the tops of the sidewalls 81 may include a sealing compound such as a layer of NEOPRENE.

Figure 10:
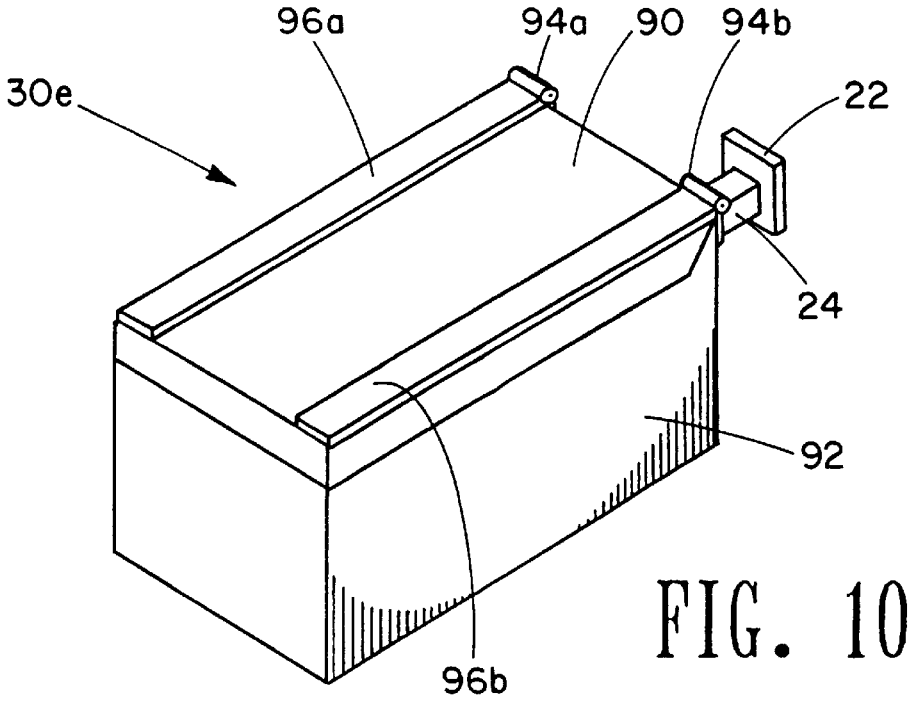
FIG. 10 is a perspective view of a fifth type of compartment.

Referring to FIG. 10, another embodiment 30*e* of a compartment 30 is shown. The compartment 30*e* is similar to compartment 30*d* except that the overlapping lid 90 is urged toward the box 92 by some other means such as spring hinges 94*a, b* and/or weighted bars 96*a,b* which will assist in retaining the steam within the compartment 30*e*.

Figure 11:
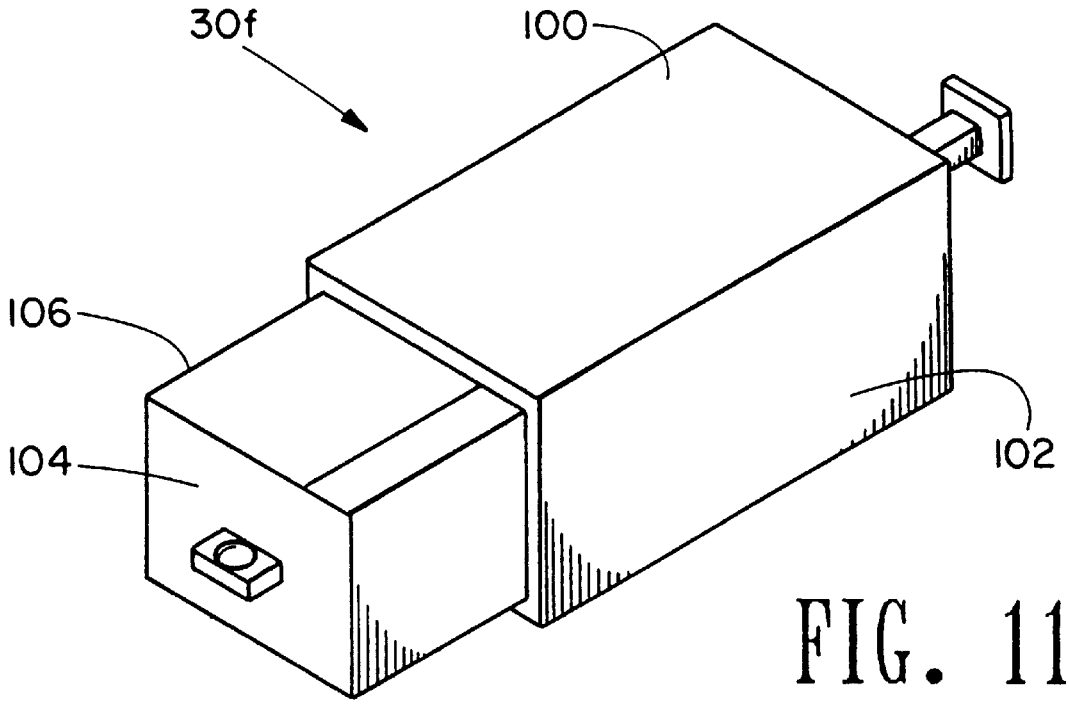
FIG. 11 is a perspective view of a sixth type of compartment.

Referring to FIG. 11, another embodiment 30*f* of a compartment 30 is shown. The compartment 30*f* includes a sleeve 100 having an endwall (not shown) and four sidewalls 102 (two shown). The other end of the sleeve 100 is open allowing the insertion of a drawer 104. The drawer 104 may contain a layer of NEOPRENE across the top edge 106 to assist in sealing the compartment 30*f* when it is closed and to assist in retaining the steam within the compartment 30*f*.

Figure 12:
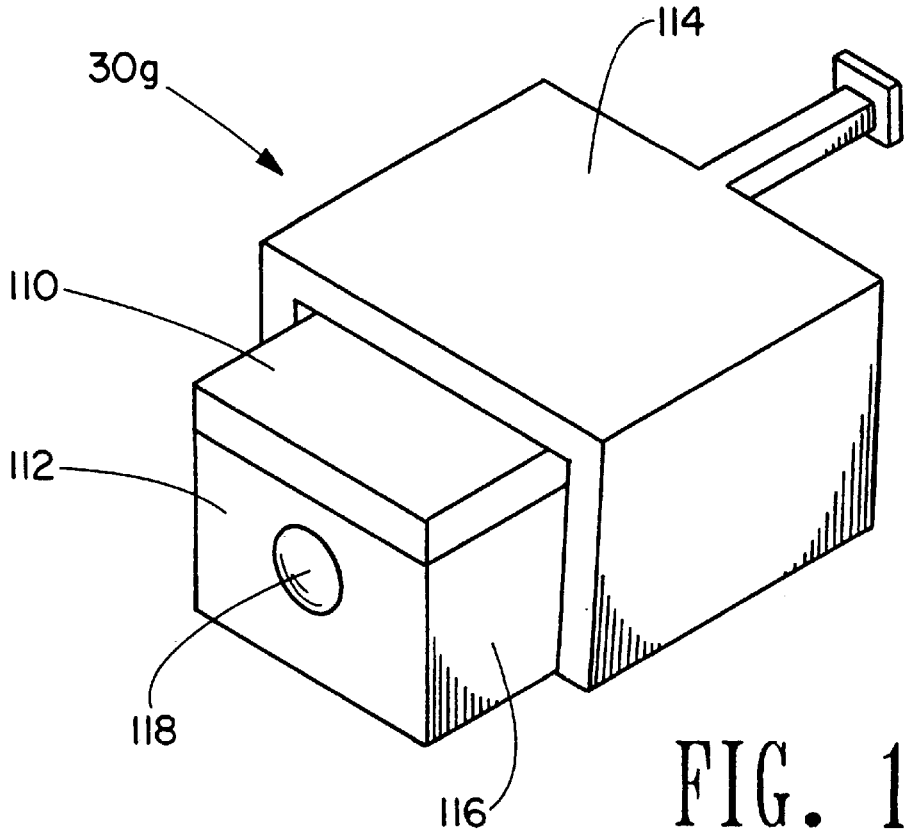
FIG. 12 is a perspective view of a seventh type of compartment.

Referring to FIG. 12, another embodiment 30*g* of a compartment 30 is shown. The compartment 30*g* includes an overlapping lid 110 which covers only a portion of the top of the box 112. The remainder of the box 112 is covered by a C-clamp 114 which engages the sidewalls 116 of box 112. The box 112 may be designed such that the C-clamp 114 will be released once the critical pressure is reached within the compartment 30*g* or to include another pressure relief mechanism 118 such as a safety valve or a poppet.

Figure 13:
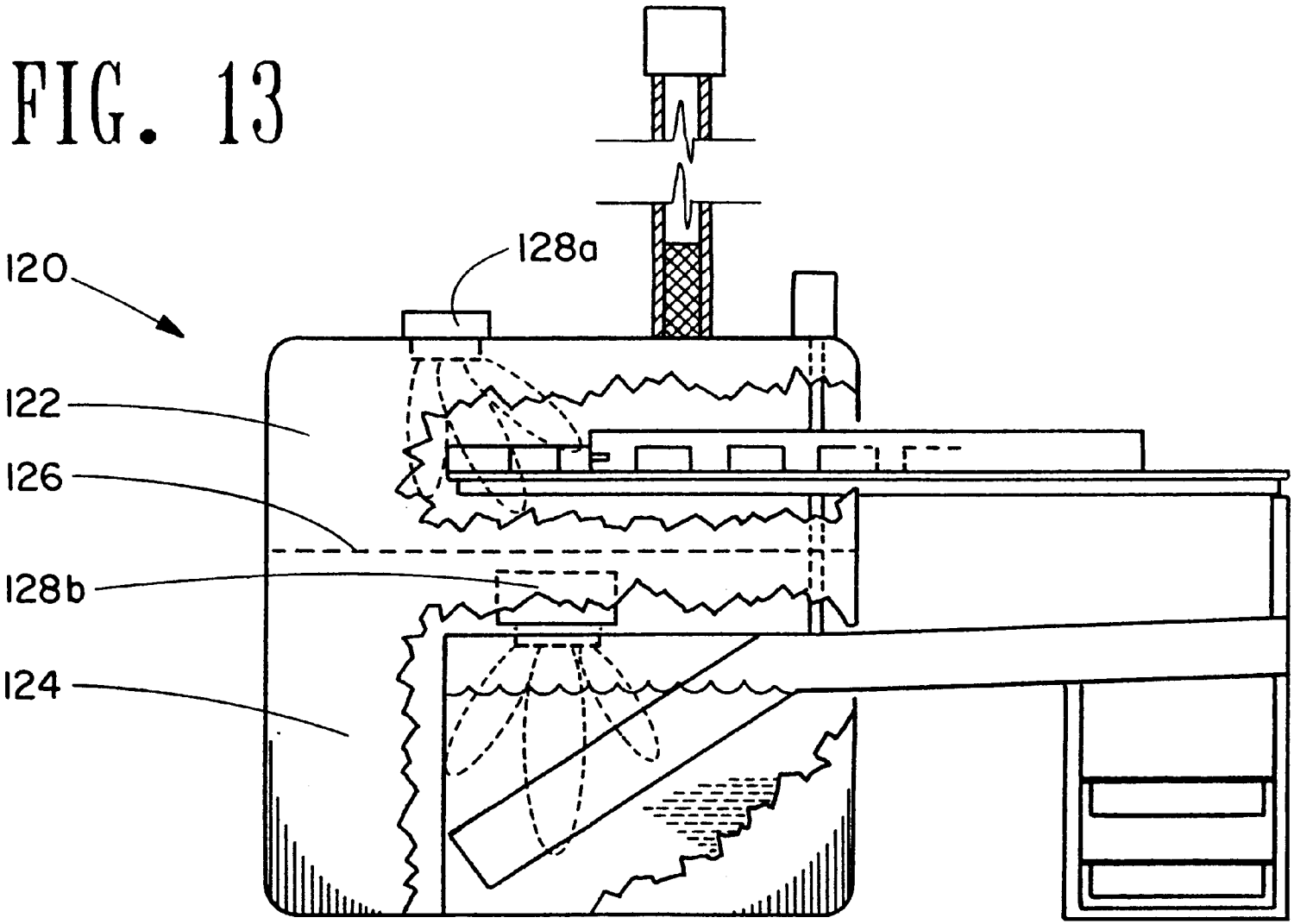
FIG. 13 is an elevational view of a combination oven having steam and microwave cooking and hot oil and microwave cooking.

Referring to FIG. 13 another embodiment of the invention is shown. This embodiment is a combination oven 120 having an upper chamber 122 for microwave and steam cooking and a lower chamber 124 for microwave and hot oil cooking. The upper chamber 122 is similar to or the same as system 10 shown in FIG. 1. The lower chamber 124 is similar to or the same as the grease containment compartment described in PCT application No. PCT/US95/10831. The upper compartment 122 and the lower compartment 124 are optionally sealed apart by a partition 126 to prevent the penetration of grease and oil into the upper chamber 122. The combination oven 120 may contain one or two microwave source/receivers 128*a,b*.

The present invention can be used both in an industrial and a home environment. For example, for applications in a home environment, the compartment 30*a* shown in FIGS. 2–6 may be manufactured without the arm 24. The home user can place a small volume of water in the trough 52 and then place a tray or trays 32 containing dumplings 34 into the receptacle 44. The receptacle 44 can then be inserted into the sleeve 40. The home user may place the compartment 30*a* into a regular microwave oven preferably having a rotating plate for the combined microwave and steam heating mentioned above.

Referring to the operation of the embodiment shown in FIG. 1, the pulleys 18*a,b* drive the belt 22 which will in turn drive the compartments 30 around the carrousel 16. An operator can place a new compartment 30 containing a pre packaged set of trays containing dumplings and water/ice onto carrousel 16 (or can open the compartments to insert dumplings into compartments 30) at the portion of the carrousel which is external to oven 12. Belt 22 drives compartments 30 into oven 12 where the food will be exposed to the microwave field. The microwave cooks the dumplings and in the meantime, converts the water/ice into steam. Since compartment 30 retains the steam, in a confined space, the dumplings will be steamed within the compartments while being cooked simultaneously by the microwave. After the compartment emerges from oven 12 it will no longer be exposed to the microwaves but the dumplings will continue to be steam cooked within the compartment until the compartment is opened. At a steam temperature of 400 degrees fahrenheit, the effect of steam heating is essentially the same as deep frying, therefore, a dumpling can be cooked by this procedure in a period of time similar to deep frying. The compartment 30 can be designed so that it will release the steam if the pressure approaches the design limit.

What is claimed is:

1. An apparatus for preparing a food product to be cooked by means of combined steam and microwave energy, comprising:

a sleeve having two open ends;

a receptacle having a platter portion adjoined by two diametrical endwalls;

wherein said diametrical endwalls each define an o-ring groove around said diametrical endwalls and each having an O-ring seated in the o-ring groove for inserting into and sealing against said sleeve;

wherein said platter portion defines a trough for holding water and two ridges bordering the trough wherein an apex of each of the ridges is equal in height; and an end piece attached to one of said diametrical endwalls wherein said endpiece includes a handle for inserting and removing said receptacle from said sleeve and a means for shielding the food operator from the steam when said receptacle is removed from said sleeve.

2. The apparatus according to claim 1 wherein one of said endwalls includes a means for releasing pressure from said receptacle when said receptacle is inside said sleeve.

3. The apparatus according to claim 1 wherein said sleeve includes a mean for releasing pressure when said receptacle is inside said sleeve.

* * * * *